US005749213A

United States Patent [19]

Stephan

[11] Patent Number: 5,749,213

[45] Date of Patent: May 12, 1998

[54] PROCESS AND DEVICE TO CONNECT A NEGATIVE-PRESSURE CHANNEL TO A NEGATIVE-PRESSURE LINE IN TEXTILE MACHINES

[75] Inventor: Adalbert Stephan, Beilngries, Germany

[73] Assignee: Rieter Ingolstadt Spinnereimaschinenbau AG, Ingolstadt, Germany

[21] Appl. No.: 670,404

[22] Filed: Jun. 25, 1996

[30] Foreign Application Priority Data

Jul. 22, 1995 [DE] Germany ..... 195 26 837.7

[51] Int. Cl.[6] ..... D01H 11/00; D01H 13/26

[52] U.S. Cl. ..... 57/304; 15/312.1

[58] Field of Search ..... 57/304, 308, 261, 57/268, 263, 276, 277; 15/312.1

[56] References Cited

U.S. PATENT DOCUMENTS

| | | | |
|---|---|---|---|
| 3,018,503 | 1/1962 | Hijiya et al. | 15/312.1 |
| 4,028,136 | 6/1977 | Kamp | 15/312.1 |
| 4,485,616 | 12/1984 | Morita et al. | 57/263 |
| 4,487,012 | 12/1984 | Horiuchi et al. . | |
| 4,498,283 | 2/1985 | Kodama et al. | 57/304 |
| 4,559,774 | 12/1985 | Stahlecker | 57/263 |
| 4,626,685 | 12/1986 | Stahlecker et al. | 57/261 |
| 4,920,739 | 5/1990 | Raasch . | |
| 5,107,670 | 4/1992 | Hauers et al. . | |
| 5,279,105 | 1/1994 | Asai et al. | 57/276 |

FOREIGN PATENT DOCUMENTS

| | | | |
|---|---|---|---|
| 0410017A1 | 7/1989 | European Pat. Off. . | |
| 0565780A2 | 12/1992 | European Pat. Off. . | |
| 1256122 | 12/1967 | Germany . | |
| 1261432 | 8/1968 | Germany . | |
| 2430439A1 | 6/1975 | Germany . | |
| 2544455B1 | 3/1977 | Germany . | |
| 2543620A1 | 7/1977 | Germany . | |
| 2701916A1 | 7/1978 | Germany . | |
| 49-1668 | 1/1974 | Japan | 57/261 |
| 892614 | 4/1958 | United Kingdom . | |
| 1092088 | 11/1964 | United Kingdom . | |

OTHER PUBLICATIONS

German Search Report, Jan. 3, 1996.

*Primary Examiner*—William Stryjewski
*Attorney, Agent, or Firm*—Dority & Manning

[57] ABSTRACT

The present invention relates to a process and device for the connection of a negative pressure channel provided with openings installed on a textile machine with a plurality of work stations. A service unit traveling alongside the textile machine is provided with a negative pressure line. The negative pressure channel has openings which are closed off by swiveling flaps. When the service unit is brought to a stop at one of the work stations, the flap associated with the work station is swivelled by means of an apparatus installed in the service unit and the negative pressure line is connected to the opening of the negative pressure channel. Before the service unit leaves the work station, the connection between the negative pressure channel and the negative pressure line is broken and the flap is necessarily swivelled by the apparatus so as to be in front of the opening in order to close the opening. The service unit has an apparatus capable of being moved in the direction of the closing surface of the flap in order to necessarily swivel said flap. The apparatus necessarily opens the flap as it moves in the direction of the closing surface and the flap is necessarily closed off again as the apparatus moves back into its starting position. The apparatus is provided with a movable line segment to connect the negative pressure line of the service unit to the negative pressure channel.

13 Claims, 7 Drawing Sheets

PROCESS AND DEVICE TO CONNECT A NEGATIVE-PRESSURE CHANNEL TO A NEGATIVE-PRESSURE LINE IN TEXTILE MACHINES

BACKGROUND OF THE INVENTION

Textile machines such as spinning or winding machines have a plurality of work stations adjoining each other. Service units are able to travel alongside the textile machines and carry out certain activities automatically in case of yarn breakage or when a bobbin is full in order to ensure a maximum of automated operation of the textile machine. Negative pressure is frequently used for this automatic activity to grasp yarn ends or to clean the work station. In order to avoid the necessity of carrying along a negative-pressure aggregate, it is customary to provide a negative-pressure channel alongside the textile machine, from which the service unit is able to take the required negative pressure at each work station.

In particular for cleaning units, the continuous taking of negative pressure from the negative-pressure channel is known. For this, DE 24 30 439 A1 proposes, for example, that a negative pressure channel be provided at the top with a through-going opening which is closed off by sealing elements. A connection piece is inserted between the seal and the channel so as to be able to supply the traveling negative-pressure lines with negative pressure from the main air channel. The disadvantage here is the fact that without special measures, negative pressure constantly prevails in the negative pressure line and that the design of the traveling unit to receive the negative pressure is costly.

For the discontinuous obtaining of negative pressure it was suggested in GB 892 614, for example, to use a negative-pressure channel with a plurality of openings. Each of these openings is closed off by means of a swiveling flap. As soon as the service unit comes into the vicinity of an opening, the connection piece of the negative-pressure line of the service unit which is pressed tightly against the main air channel moves the flap away from the opening and establishes a connection between negative-pressure channel and negative-pressure line. The disadvantage in this solution is the fact that each time the service unit reaches the vicinity of an opening, the flap is swivelled and thus produces a loss of negative pressure, even when the service unit does not have any task to perform at the work station in question. It is furthermore disadvantageous that the flap is to close off the opening on the one hand through its own weight, but is on the other hand pressed by the negative pressure against the sides of the compressed-air channel surrounding the opening so that secure closure of the opening is not always ensured.

In order to ensure secure closure of the opening, GB 1 092 088 preposes that a double flap be used. Here, as in GB 892 614, the connection piece of the negative-pressure line of the service unit is used as the switching element of the flap. In this proposal not only the opening of the flap, but also the closure of the opening is effected by the suction connection piece. While in the one direction of travel, the first leg of the flap is swivelled from a closed position into an open position, the second leg is moved from the open position into a closed position as the service unit leaves. When the service unit changes direction of travel, the flap is moved in reverse sequence. In this embodiment, as much as in the previously described embodiment, it is a disadvantage that each time the service unit passes by an opening, negative pressure is taken out. This leads to pressure losses in the negative pressure channel and to an increased energy consumption. Despite these disadvantages, such negative pressure channels and flaps are used in most of the textile machines in operation at this time. Because of increasing energy costs on the one hand and the requirement of maintaining as constant negative pressures as possible on the service units, even when several service units are used, the known units are inadequate.

OBJECTS AND SUMMARY OF THE INVENTION

It is therefore a principal object of the present invention to create a process and an apparatus by means of which the disadvantages described above are avoided and a simple, low-cost and low-maintenance connection between a service unit and a negative pressure channel is ensured.

Additional objects and advantages of the invention will be set forth in part in the following description, or may be obvious from the description, or may be learned through practice of the invention.

According to the invention, the service unit is brought to a halt at one of the work stations and the flap associated with the work station is then swivelled by means of an apparatus installed in the service unit. The negative pressure line is connected to the opening of the negative pressure channel, and before the service unit leaves the work station, the connection between negative pressure channel and negative pressure line is broken. The flap is necessarily swivelled by the apparatus so as to be in front of the opening. This has the advantage that the flap opens the negative pressure channel only when the service unit has accomplished its tasks at the work station. The negative pressure in the negative pressure channel is therefore not taken out during normal travel of the service unit past the openings, so that on the one hand energy is saved and on the other hand a constant negative pressure is present for the other service unit. Due to the necessary swiveling of the flap in order to close the opening, it is ensured that the flap closes the opening completely so that no loss of negative pressure occurs in the negative pressure channel. Furthermore the flap is then again in a defined posiiton from which it can be opened by the apparatus of the service unit. The opening by the apparatus is effected independently of the side from which the service unit approaches the work station.

The negative pressure channel and the negative pressure line are advantageously connected to each other by means of a movable line segment. This ensures that the service unit can bridge the space between the negative pressure line and the negative pressure channel and is thus able to take negative pressure from the negative pressure channel. If the line segment is moved in a straight line, simple design of the apparatus is possible.

Simple design is furthermore made possible through the fact that the swiveling of the flap and the connection between the negative pressure channel and the negative pressure line occur substantially at the same time. This ensures that once the flap has been swivelled, the opening of the negative pressure channel is left for only a short time without connection to the negative pressure line. The loss of negative pressure is thus kept to a minimum.

Especially simple design is obtained if the flap is swivelled by means of a sliding guide which is directed by a pin of the apparatus. This makes it possible to move the apparatus in a linear manner, while the flap is turned away from the opening of the negative pressure channel.

In a textile machine according to the invention, the service unit is provided with an apparatus capable of being moved in the direction of the closing surface of the flap for the forcible swiveling of the flap. In a movement in the direction of the closing surface, the flap necessarily opens, and in return movement to its starting position, the flap necessarily closes the opening. According to the invention, a moveable line segment for the conection between the negative pressure line of the service unit and the negative pressure channel is assigned to the apparatus. By means of the present invention the advantageous result is that the negative pressure channel is open for only a brief period of time before the negative pressure line of the service unit is connected to the negative pressure channel. It is furthermore ensured that the swiveling flap is always in a defined posiiton as it leaves the service unit. Aspiration of the flap against the negative pressure channel by the negative pressure prevailing in said negative pressure channel before the flap has closed the opening completely is avoided. The movable line segment of the negative pressure line ensures that the opening is closed again immediately after the guiding element has swivelled the flap. The negative pressure is then present in the service unit.

If the apparatus is mounted on the negative pressure line so as to be axially movable, this makes it possible to obtain a simple design of the movement of the apparatus. Additional bearing points are avoided if the apparatus is mounted on the negative pressure line. Simple and good mobility of the apparatus is achieved in that bushings are located between the apparatus and the negative pressure line, and in that the negative pressure line is designed as a guiding tube for the apparatus.

In order to effect a connection of the apparatus to the negative pressure channel by means of which as little negative pressure as possible is lost, it is advantageous for a sealing surface to be provided at the outlet of the movable line segment.

The drive of the apparatus is especially simple if a pneumatic cylinder is used.

If the swiveling flap has a sliding guide interacting with a pin of the apparatus, it is possible through a simple design for the apparatus to be moved in a linear manner while the flap is swivelled away from the opening. The sliding guide is designed so that it allows for sufficient swiveling of the flap. For a better introduction of the pin into the slide it may be advantageous for the sliding guide to be slightly wider at the beginning. Good movement of the pin in the slide, with little friction, is achieved if the slide is located in a cylinder segment. The rotatable mounting of the pin represents an additional measure for low-friction and therefore low-wear movement of the flaps. If the movable line segment and the pin are mounted on a swiveling lever, simultaneous movement of the line segment and swiveling of the flap are easily achieved. Suitable placement of the pivot points of the lever, as well as of the movable line segment together with the placement of the pin, make it possible to achieve simultaneous movement of the line segment to the opening and removal of the flap by the pin.

It is especially advantageous for the sliding guide to be made of polyester and the pin to be made of steel. This represents a selection of an association of especially low-friction and low-wear materials.

Alternatively however, it is equally possible according to the present invention to design the sliding guide in a straight line and to twist the apparatus helicoidally. This also has as a result that the flap is rotated away from the opening.

The slide can either be made in the form of a slit, or can be raised. If the slide is in the form of a slit, the pin engages an opening of the slide and turns the flap. If the slide is raised, a cable-shaped component surrounds the slide and opens and closes the flap necessarily.

If the swiveling axis of the flap is located above the opening of the compressed-air channel, the flap is always automatically rotated by gravity so as to be over the opening of the compressed-air channel. The apparatus is thus able to turn the flap in front of the opening without requiring much force.

The present invention is described hereinafter through examples of embodiments.

DETAILED DESCRIPTION OF THE PREFERRED EMBODIMENTS

Figure 1:
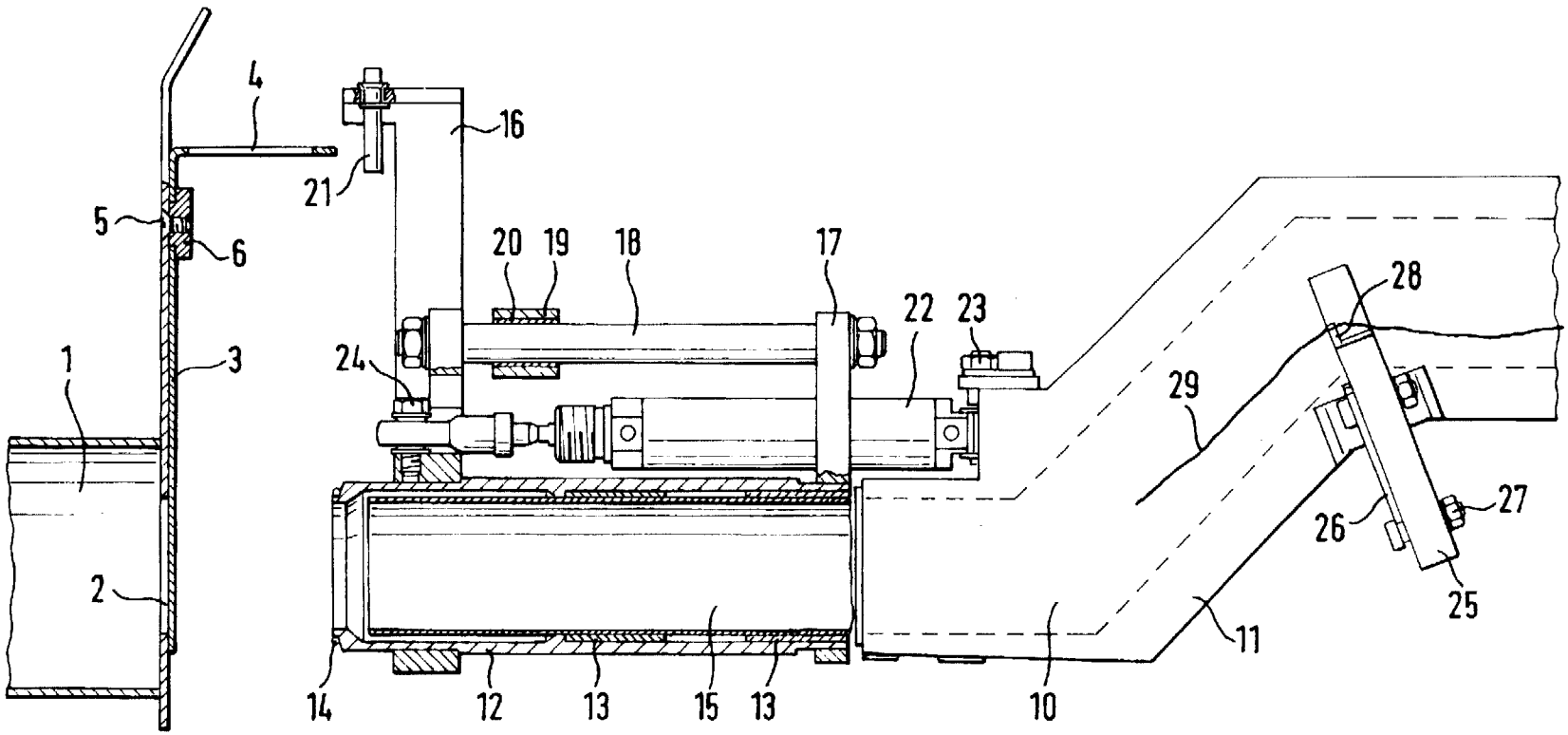
FIG. 1 is a side view of an apparatus according to the invention and of a flap to close a negative pressure channel.

Reference will now be made in detail to the present preferred embodiments of the invention, one or more examples of which are illustrated in the drawings. Each example is provided by way of explanation of the invention, and not as a limitation of the invention. For example, features illustrated or described as part of one embodiment can be used on another embodiment to yield a still further embodiment. It is intended that the present invention cover such modifications and variations.

FIG. 1 shows an example of an embodiment of the present invention in a side view. A negative pressure channel 1 which runs along the textile machine 100 in FIG. 1*a* has several openings 2. Each of these openings 2 is closed off by a flap 3 corresponding to work stations 300 (FIG. 1*a*) of textile machine 100. A sliding guide 4 is installed at the flap 3 and is at a right angle to said flap 3. The flap 3 can be swivelled by means of this sliding guide 4. The flap 3 is swivelled via a swivel axle. The swivel axle consists of a screw 5 and a disk 6. The disk 6 has an extension which is larger than the thickness of flap 3. This makes a rotational movement of the flap 3 below the disk 6 possible. Screw 5 and disk 6 are located above the opening 2 of the negative pressure channel 1. In this manner automatic closing of the opening 2 by the flap 3 as a result of gravity is assisted.

Figure 1A:
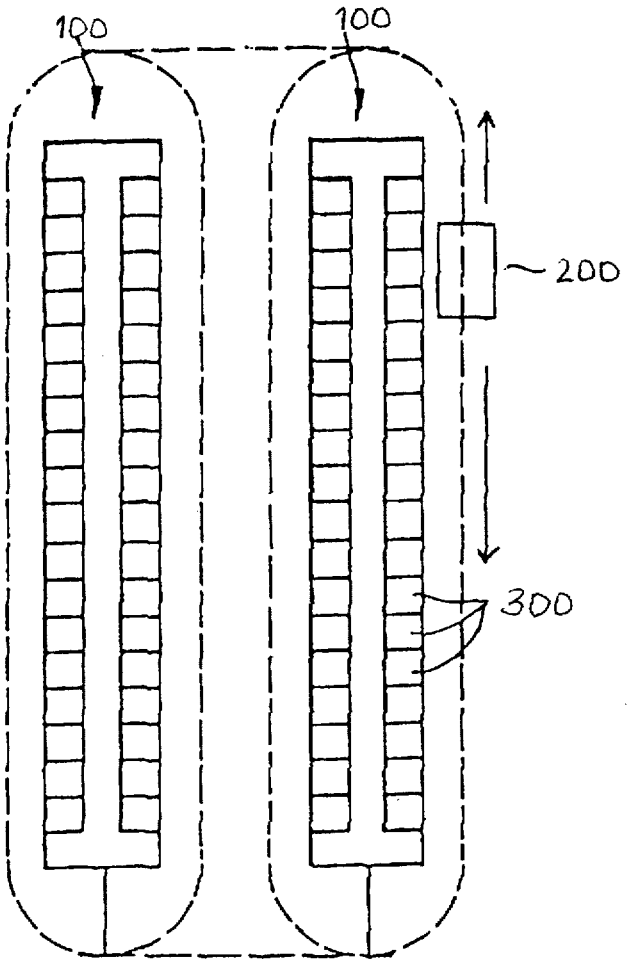
FIG. 1*a* is a diagramatic view of a textile machine with a plurality of work stations and traveling service unit.

In the service unit, which is diagramatically shown as element 200 in FIG. 1*a* and is able to travel alongside the textile machine, a negative pressure line 10 is installed. The negative pressure line runs inside a housing 11. A movable line segment 12 is provided at the outlet of the negative pressure line 10. The movable line segment 12 is connected via bushings 13 to a guiding pipe 15. The outlet of the movable line segment 12 is provided with a seal 14 in order to provide connection of the line segment 12 to the opening 2 without loss of negative pressure. Thanks to the bushings 13, easy sliding of the line segment 12 on the guiding pipe 15 is possible.

An opener angle 16 and a connection plate 17 are attached to the line segment 12. Between the opener angle 16 and the connection plate 17 is a guiding bolt which is installed in a bearing block 19 and bushing 20 so as to be capable of sliding in the axial direction. Furthermore, a pin 21 is installed on the opener angle 16 and interacts with the slide 4 of the flap 3. The apparatus for the opening of the flap 3 is actuated by means of pneumatic cylinder 22. The pneumatic cylinder 22 is connected in bearings 23 and 24 on the one side with the housing 11 of the negative pressure line 10 and on the other side to the movable line segment 12 via the opener angle 16. When the pneumatic cylinder 22 is actuated the apparatus with the line segment 12, the opener angle 16 and the pin 21 moves in the direction of flap 3 or slide 4. Through the interaction of the pin 21 and the slide 4 the flap 3 is swiveled away from the opening 2 and line segment 12 is brought together with the seal 14 to the opening 2 and is connected in a sealing manner. Thereby a connection between the negative pressure line 10 of the service unit traveling alongside the work stations and the negative pressure channel 1 extending alongside the work station is established.

If the negative pressure line 10 is used to aspire a yarn end on a bobbin, it is advantageous to provide a yarn monitor 25 in the negative pressure line 10 according to the embodiment shown in FIG. 1. For this purpose, the negative pressure line 10 is bent twice, so that the yarn is necessarily conveyed over the yarn monitor 25. The yarn then lies on a sensor 28 of the yarn monitor 25 so that it is possible to ascertain whether the yarn was aspired in sufficient length or whether an aspiration attempt must be repeated. The double bend in the negative pressure 10 causes the yarn 29 to be placed inside the negative pressure line 10 on the yarn monitor 25 in such a manner that it produces a signal on the sensor 28. The yarn monitor 25 is held via a holder 26 and a screw 27 to the housing 11 of the negative pressure line 10.

Figure 2:
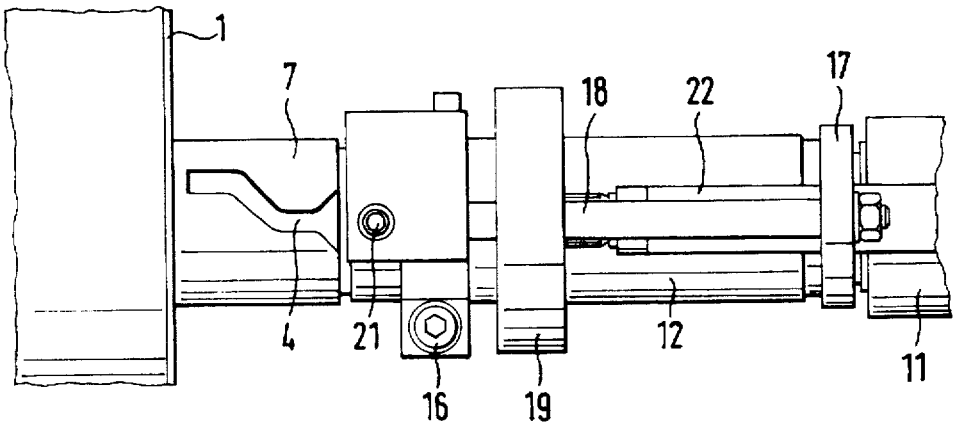
FIG. 2 is a top view of the apparatus of FIG. 1.

FIG. 2 shows a top view of the embodiment of FIG. 1. The flap 3 with its sliding guide 4 and the slide 7 is installed on the negative pressure channel 1. The sliding guide 4 is provided with an introduction funnel so that the pin 21 of the apparatus can be introduced without problems into the sliding guide 4 on the service unit. The sliding guide 4 is designed so as to ensure that the flap 3 is swivelled away from the opening 2 of the negative pressure channel 1 as result of linear introduction of the pin 21 into the sliding guide 4 of opening 2 of the negative pressure channel 1.

The overall apparatus in the service unit moved by means cylinder 22 in the direction of the negative pressure channel 1. The apparatus then slides by means of the guiding bolt 18 in the bearing block 19 in such a manner in the direction of the negative pressure channel that the pin 21 is introduced into the sliding guide 4. The pin 21 is attached via opener angle 16 to the line segment 12. The guiding bolt 18 is also connected to the line segment 12 via the opener angle 16 and the connection plate 17. The pneumatic cylinder 22 is connected via joint heads to the opener angle 16 and the housing 11 of the negative pressure line 10.

Figure 3:
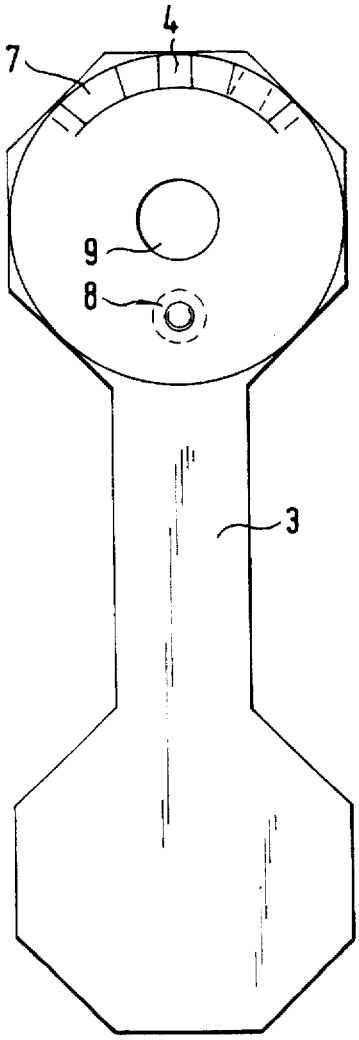
FIG. 3 is a front view of a flap.

FIG. 3 shows an embodiment of a flap 3 with slide 7. Slide 7 is connected to the flap 3 by means of a screw. The flap 7 is made in form of a section of circle relative to a bore 9 which is concentric with it. The bore 9 serves as rotational axis which the screw 5 and disk 6 shown in FIG. 1 are engaged. Thanks to the design of the slide 7 in the form of a section of a circle, gentle and low-friction movement of the pin 21 is achieved.

Figure 4:
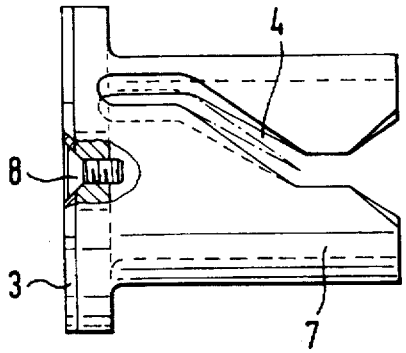
FIG. 4 is a top view of a sliding guide.

FIG. 4 shows a top view of the flap 3 of FIG. 3. The form of the sliding guide 4 is clearly shown here. The sliding guide 4 is provided with an insertion funnel so that the pin 21 can be inserted without difficulty into the sliding guide 4. The sliding guide 4 is designed so that it is inclined towards the pivotal point of flap 3. In this manner as linear as possible a contact between pin 21 and sliding guide 4 is obtained so that low friction is possible. The slide 7 is attached to the flap 3 by means of screw 8. It may also be bonded in order to ensure secure attachment. It is however also possible to make the slide 7 and the flap 3 in one piece. In this case bonding and fastening by means of screw 8 is not necessary. If the sliding guide 4 is raised, this means that a ridge is placed on the slide 7. The form of the ridge corresponds substantially to the form of the sliding guide 4 as shown in FIG. 4, with the exception that the insertion funnel does not spread out but comes together. This coming together of the insertion funnel facilitates the insertion of a fork-shaped component instead of the pin 21.

Figure 5B:
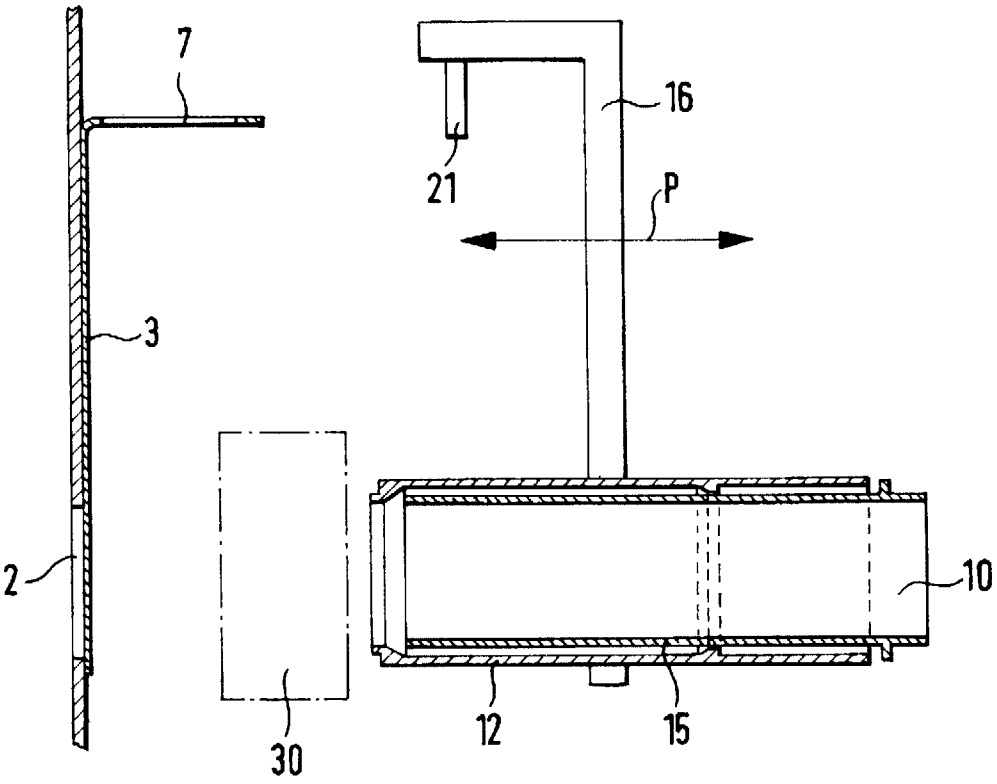
FIG. 5*b* is a schematice view of an apparatus according to the invention.
Figure 5A:
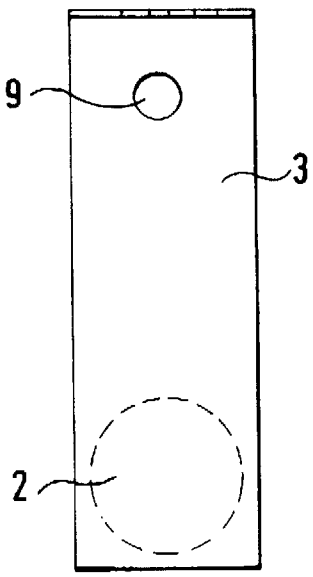
FIG. 5*a* is a front view of a flap in a closed state.

FIG. 5*a* shows a flap 3 which closes off the opening 2 of the negative pressure channel 1. The flap 3 is mounted rotatably over bore 9. FIG. 5*b* again shows opening 2 with flap 3 and slide 7 in closed position. The movable apparatus is shown schematically, whereby the line segment 12 is capable of back and forth movement in direction of movement P on the guiding pipe 15 of the negative pressure line 10. The pin 21 is located on the opener angle 16. An additional cutting device 30 is provided between the line segment 12 and the opening 2. By means of this cutting device 30, it is possible to cut off a yarn end which has been introduced into the negative pressure channel 1 through opening 2. Catching of the yarn between flap 3 and opening 2 is thus avoided when the service unit leaves the work station again and the flap 3 closes off opening 2. The cutting device 30 is advantageously actuated when the service unit has already left the work station. A section of yarn located at the interface between line segment 12 and opening 2 is then cut off, with the yarn end towards opening 2 being aspired into the negative pressure channel 1 so that catching between flap 3 and opening 2 when said opening 2 is being closed is avoided.

Figure 6B:
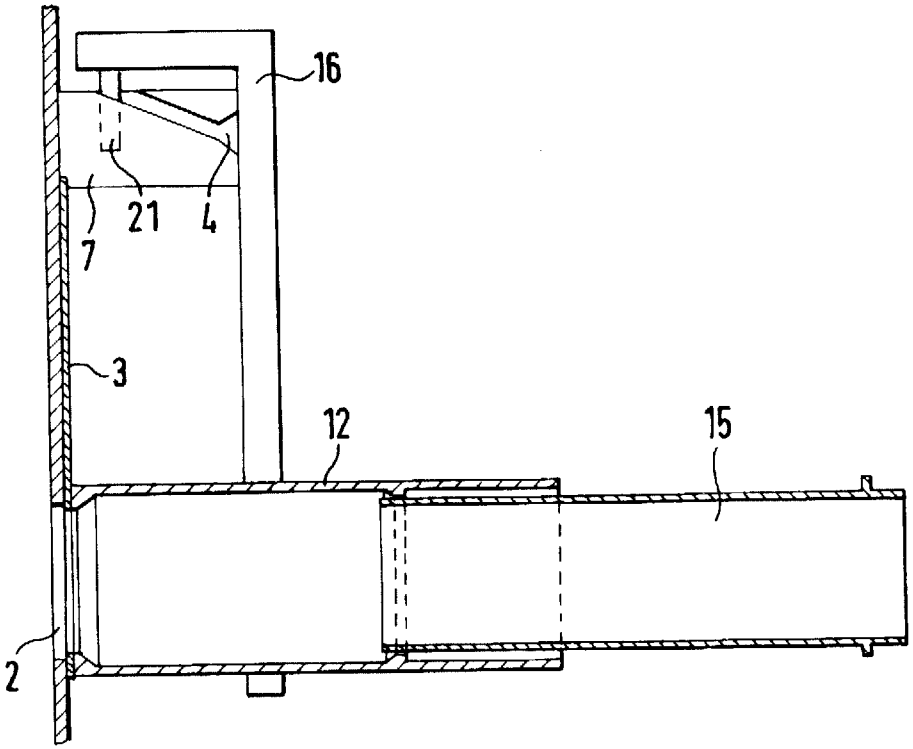
FIG. 6*b* is a side view of the apparatus, with connected line segment.
Figure 6A:
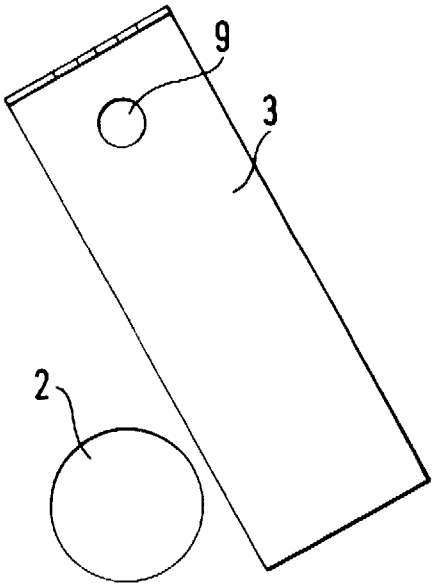
FIG. 6*a* is a front view of an open flap.

FIG. 6*a* shows the schematic view according to FIG. 5*a*, but here in open state. Flap 3 is here swivelled away from opening 2. The bore 9 is the axis of rotation. FIG. 6*b* shows the schematic view of the apparatus in coupled state. In this case, the opener angle 16 is inserted with part 21 in the sliding guide 4 of the slide 7. Flap 3 is in an open position, so that the line segment 12 is placed on opening 2 of the negative pressure channel 1 as a result. The line segment 12 is displaced on the guiding pipe 15 of the negative pressure line 10. In this position, a connection between negative pressure line 10 and negative pressure channel 1 is established, so that the negative pressure is present in the service unit.

Figure 7:
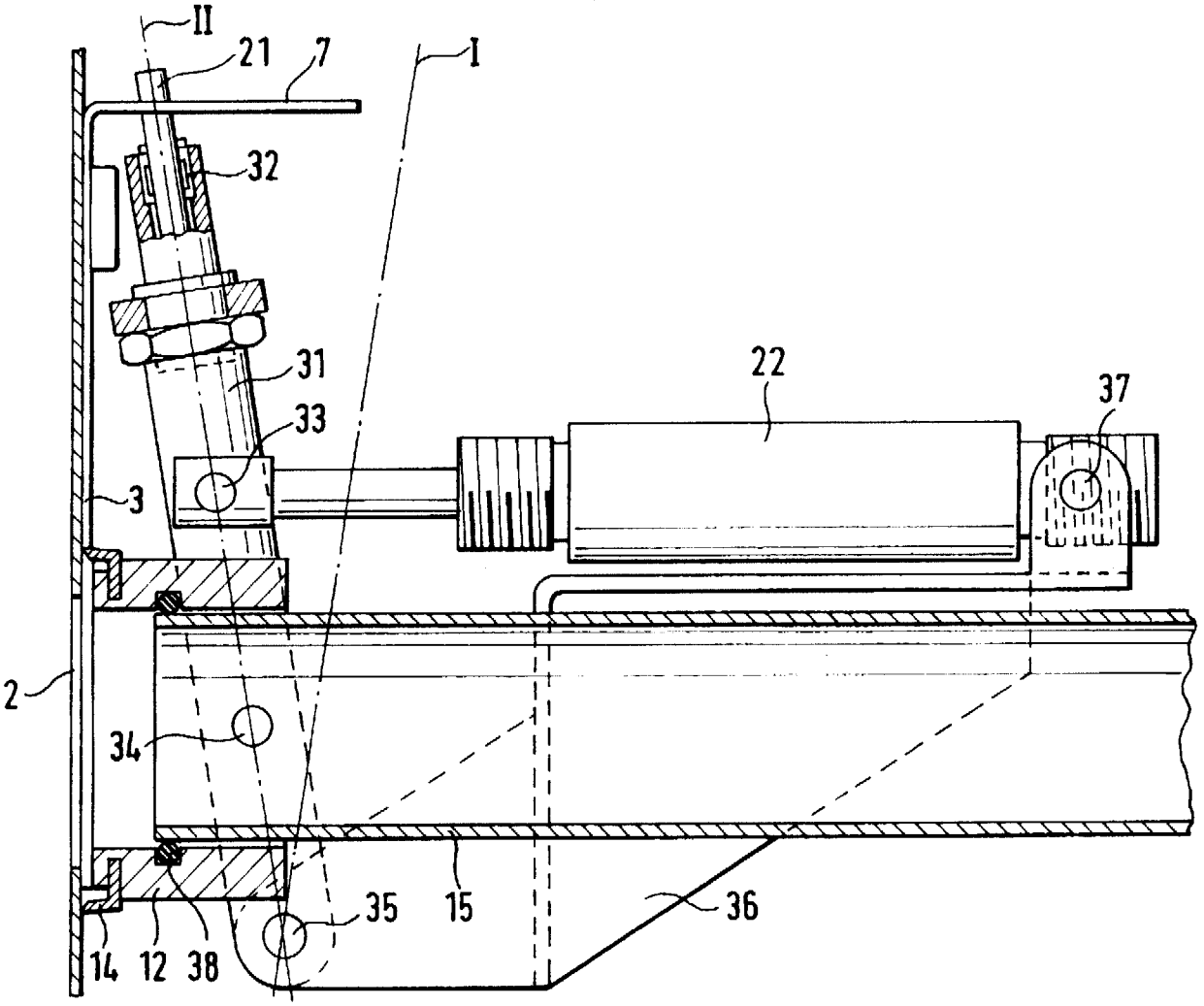
FIG. 7 is a side view of an apparatus according to the invention, with a pin and guiding element located on a lever

FIG. 7 shows another embodiment of the present invention. In the side view shown, a short line segment 12 is installed on the guide pipe 15. The outlet of the line segment 12 is provided with a seal. In the position shown, the line segment 12 is in contact via seal 14 with opening 2 of the negative pressure channel 1, so that negative pressure is able to enter the service unit. Between guide pipe and line segment 12, a seal 38 is installed which on the one hand promotes simple and easy displacement of the line segment 12 on the guiding pipe 15 and on the other hand seals off the gap between line segment 12 and guiding pipe 15.

The pin 21 is mounted in a roller bearing 32. As a result, low-friction movement of the pin 21 in the slide 7 or in the sliding guide 4 is possible. Pin 21 is attached to a lever which is rotatably mounted in a pivot point 35. In addition, the line segment 12 is rotatably mounted in a bearing 34 on the lever 31. An additional bearing 33 in which the pneumatic cylinder 22 attacks is located between pin 21 and bearing 34. The pneumatic cylinder 22 is mounted in stationary position in bearing 37. By actuating the pneumatic cylinder 22, the lever 31 is moved via bearing 33 from position I into position II. Position I is the starting position which is in the position of the pin 21 when the service unit travels alongside the work stations. When the service unit is standing in front of a work station where it has to perform some tasks, the pin 21 is moved from position I into position II in that the pneumatic cylinder 22 swivels the lever 31 via bearing 33 and pivot point 35. This causes flap 3 to be swivelled away form opening 2. The pivot point 35 is installed in a holder 36 in stationary position in the service unit.

Figure 8:
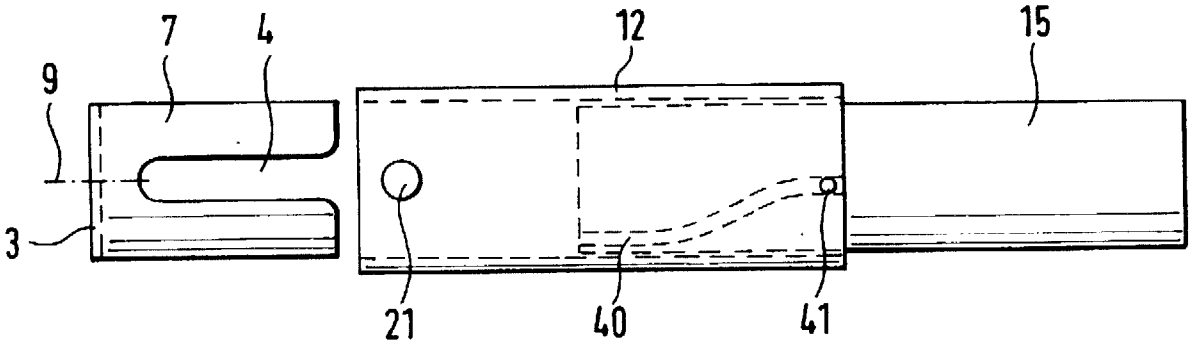
FIG. 8 is a sketch of another embodiment.

FIG. 8 shows an alternative embodiment in which a guide 40 in the form of screw threads is installed on the guiding pipe 15. The sliding guide 4 of the slide 7 is here in a straight line. The line segment 12 is provided with a pin 41 which can be moved in the guide 40. In this manner the line segment 12 is rotated together with the pin 21. As soon as the pin 21 is introduced into the sliding guide 4 the flap 3 is rotated around the rotational axis of bore 9 and opens opening 2.

The present invention is not limited to the embodiments shown as examples. In fact, it will be apparent to those skilled in the art that various modifications and variations can be made in the present invention without departing from the scope and spirit of the invention. It is intended that the present invention cover such modifications and variations as come within the scope of the appended claims and their equivalents.

I claim:

1. A negative pressure system for a textile machine having a plurality of adjacently disposed work stations, said pressure system comprising:

a negative pressure channel extending alongside said textile machine, said channel comprising an opening at each said work station;

a swiveling flap disposed at each said opening to cover said opening in an airtight manner in a closed position and to uncover said opening in an open position thereof;

a traveling service unit configured to travel alongside said textile machine, said service unit further comprising an operable member for swiveling said swiveling flap, said operable member movable from a starting position on said service unit in a direction substantially traverse to direction of movement of said travel unit towards said flap to engage and swivel said flap to said open position, said operable member releasing said flap upon moving back to said starting position; and a movable line segment configured with said traveling service unit to move into an engaging configuration with said opening after said operable member swivels said flap to said open position so as to connect said negative pressure channel to said service unit.

2. The system as in claim 1, wherein said service unit comprises a negative pressure line, said movable line segment connecting said negative pressure line with said negative pressure channel.

3. The system as in claim 2, wherein at least a portion of said negative pressure line serves as a guide member for said movable line segment.

4. The system as in claim 3, wherein said movable line segment telescopes over said guide member.

5. The system as in claim 4, further comprising bushing devices disposed between said movable line segment and said guide member.

6. The system as in claim 1, further comprising a sealing device disposed on said movable line segment for sealing engagement with said negative pressure channel.

7. The system as in claim 1, further comprising a pneumatic drive mechanism for moving said operable member and said movable line segment.

8. The system as in claim 1, wherein said swiveling flap comprises a sliding guide extending therefrom, said operable member comprising a pin which engages said sliding guide upon movement of said operable member towards said swiveling flap causing said swiveling flap to swivel about a swivel point.

9. The system as in claim 8, wherein said sliding guide is defined by a cylinder member.

10. The system as in claim 9, wherein said sliding guide comprises a helicoidal slit defined in said cylinder member.

11. The system as in claim 8, wherein said pin is rotatably mounted.

12. The system as in claim 8, further comprising a movable lever, said pin and said movable line segment connected to said movable lever and actuated thereby.

13. The system as in claim 8, wherein said sliding guide comprises a slit, said pin engaging in said slit.

* * * * *

UNITED STATES PATENT AND TRADEMARK OFFICE

CERTIFICATE OF CORRECTION

PATENT NO. : 5,749,213

DATED : MAY 12, 1998

INVENTOR(S) : ADALBERT STEPHAN

It is certified that error appears in the above-identified patent and that said Letters Patent is hereby corrected as shown below:

Claim 1, column 8, line 5, delete "traverse" and substitute therefor --transverse--.

Signed and Sealed this
First Day of February, 2000

*Attest:*

*Attesting Officer*

Q. TODD DICKINSON

*Acting Commissioner of Patents and Trademarks*